US009470159B2

(12) United States Patent
Gottschalk et al.

(10) Patent No.: US 9,470,159 B2
(45) Date of Patent: Oct. 18, 2016

(54) METHOD FOR DETERMINING AN AMOUNT OF FRESH AIR IN A CYLINDER OF AN INTERNAL COMBUSTION ENGINE

(71) Applicant: IAV GmbH Ingenieurgesellschaft Auto und Verkehr, Berlin (DE)

(72) Inventors: Wolfram Gottschalk, Magdeburg (DE); Franz Kallage, Hannover (DE); Christian Riechert, Allerbuettel (DE); Matthias Schultalbers, Meinersen (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 609 days.

(21) Appl. No.: 13/754,949

(22) Filed: Jan. 31, 2013

(65) Prior Publication Data

US 2013/0204509 A1 Aug. 8, 2013

(30) Foreign Application Priority Data

Feb. 3, 2012 (DE) ..... 10 2012 002 030

(51) Int. Cl.

| | |
|---|---|
| ***F02D 35/02*** | (2006.01) |
| ***F02D 41/26*** | (2006.01) |
| ***F02D 41/38*** | (2006.01) |
| *F02D 41/14* | (2006.01) |

(52) U.S. Cl.

CPC ..... *F02D 35/023* (2013.01); *F02D 41/26* (2013.01); *F02D 41/38* (2013.01); *F02D 2041/1433* (2013.01); *F02D 2041/389* (2013.01); *F02D 2200/0602* (2013.01)

(58) Field of Classification Search

CPC .. F02D 41/38; F02D 41/3809; F02D 41/023; F02D 41/024; F02D 2200/0602; F02D 2041/389; F02D 35/023; F02D 35/024; G01M 15/08

USPC ..... 701/103, 104; 123/456, 435, 704; 73/114.16, 114.37, 114.43, 114.15

See application file for complete search history.

(56) References Cited

U.S. PATENT DOCUMENTS

| | | | | |
|---|---|---|---|---|
| 6,427,527 | B1 | 8/2002 | Langer | |
| 8,899,203 | B2 * | 12/2014 | Thomas | 123/179.3 |
| 2001/0037791 | A1 * | 11/2001 | Bochum | 123/295 |
| 2003/0160118 | A1 | 8/2003 | Schmauser | |
| 2005/0279322 | A1 * | 12/2005 | Kufferath | 123/299 |

(Continued)

FOREIGN PATENT DOCUMENTS

| | | | |
|---|---|---|---|
| DE | 19946874 | A1 | 4/2001 |
| DE | 19958465 | A1 | 7/2001 |
| DE | 10047811 | A1 | 4/2002 |

(Continued)

*Primary Examiner* — Lindsay Low
*Assistant Examiner* — Robert Werner
(74) *Attorney, Agent, or Firm* — Leydig, Voit & Mayer, Ltd.

(57) ABSTRACT

A method for determining the proportion of gaseous working medium in a cylinder of an internal combustion engine includes opening an injector so as to feed fuel directly into the cylinder. The injector is connected to a fuel line in which a pressure sensor is arranged. The pressure in the fuel line is measured when the injector is open. The proportion of gaseous working medium in the cylinder is determined in conjunction with an association between the measured pressure in the fuel line when the injector is open and the proportion of gaseous working medium in the cylinder.

9 Claims, 2 Drawing Sheets

(56) References Cited

U.S. PATENT DOCUMENTS

| | | | |
|---|---|---|---|
| 2008/0314359 | A1 | 12/2008 | Thomas |
| 2011/0178693 | A1 | 7/2011 | Chang et al. |

FOREIGN PATENT DOCUMENTS

| | | | |
|---|---|---|---|
| DE | 10127932 | A1 | 12/2002 |
| DE | 10236615 | A1 | 2/2004 |
| DE | 10353434 | A1 | 6/2005 |
| DE | 102005036826 | A1 | 2/2007 |
| DE | 102007013460 | A1 | 11/2007 |
| DE | 102008023104 | A1 | 12/2008 |
| DE | 102008027585 | A1 | 12/2009 |
| DE | 102008040861 | A1 | 2/2010 |
| DE | 102011008798 | A1 | 9/2011 |
| DE | 102010054997 | A1 | 6/2012 |

* cited by examiner

METHOD FOR DETERMINING AN AMOUNT OF FRESH AIR IN A CYLINDER OF AN INTERNAL COMBUSTION ENGINE

CROSS REFERENCE TO RELATED APPLICATIONS

This application claims priority to German Patent Application No. 10 2012 002 030.9, filed on Feb. 3, 2012, which is hereby incorporated by reference herein in its entirety.

FIELD

The present invention relates to a method for determining the proportion of gaseous working medium in the cylinder of an internal combustion engine.

BACKGROUND

As is generally known, the proportion of fresh air in the cylinders of an internal combustion engine is an important process variable. To carry out combustion of fuel in a manner which is as effective as possible with the lowest amount of pollution possible, a precise adjustment of the proportion of fuel and of the proportion of fresh air in the cylinders is particularly significant. As is generally known, to determine the proportion of fresh air in the cylinders of an internal combustion engine, it is possible to measure the pressure in the intake system, it being assumed that at the moment when the inlet valves are closed, the pressure in the intake system is consistent with the pressure in the cylinders. As is also generally known, to determine the proportion of fresh air in the cylinders of an internal combustion engine, the mass flow of fresh air which flows into the intake system can be measured, for example by a hot film air mass meter. The mentioned methods cannot determine the manner in which the fresh air is distributed onto the individual cylinders of an internal combustion engine. The mentioned methods also suffer from the shortcoming that, inter alia, due to the storage effect of the intake system and to the inertia of the fresh air, the intake system or the cylinders are filled and emptied in a delayed manner and thus the signals used respectively in dynamic operating phases of the internal combustion engine do not describe the actual proportion of fresh air in the cylinders. However, for a low-pollution conversion of fuel, it is absolutely necessary to know as accurately as possible the proportion of fresh air which is contained in the individual cylinders. According to DE 10 2007 013 460 A1, it is already known to use pressure sensors to determine the pressure in the cylinders of an internal combustion engine. The combustion phase position and/or the indicated mean effective pressure are determined by means of the cylinder pressure. The combustion phase position and/or the indicated mean effective pressure are used in conjunction with a known thermal efficiency to determine an energy conversion and/or a proportion of fuel to be fed to the cylinders. Furthermore, the air mass in the cylinders of the internal combustion engine is determined from the proportion of fuel to be fed to the cylinders, in conjunction with a combustion air ratio which is established using a residual oxygen sensor, and with the known oxygen concentration in the air. In other words, a distribution of the fresh air onto the individual cylinders of an internal combustion engine can be determined by this method. However, this requires cylinder pressure sensors which, as is known, are expensive and nondurable, that is to say, hitherto they have not found their way into series production. Furthermore, in this method, a residual oxygen sensor is required, so that differences in measurements which may result from the two sensors which are used become more frequent. DE 10 2008 023 104 A1 also discloses a method for starting an internal combustion engine, the method comprising the determination of a cylinder stroke during the starting of the engine as a reaction to a distributing pipe pressure. DE 102 36 615 A1 discloses a method for detecting a signal representing the pressure in the combustion chamber of an internal combustion engine operating with direct injection, the fuel injection valves of which are provided for actuation with a piezoelectric converter element. The signal which is picked up by the piezoelectric converter element can be used as a pressure signal. The signal picked up outside the injection phase is advantageously used to detect the knocking signal.

SUMMARY

An aspect of the present invention is to determine, using simple means, the proportion of fresh air which is contained in the cylinder of an internal combustion engine.

In an embodiment, the present invention provides a method for determining the proportion of gaseous working medium in a cylinder of an internal combustion engine including opening an injector so as to feed fuel directly into the cylinder. The injector is connected to a fuel line in which a pressure sensor is arranged. The pressure in the fuel line is measured when the injector is open. The proportion of gaseous working medium in the cylinder is determined in conjunction with an association between the measured pressure in the fuel line when the injector is open and the proportion of gaseous working medium in the cylinder.

BRIEF DESCRIPTION OF THE DRAWINGS

Further advantageous configurations of the present invention are described with respect to the drawings, in which.

DETAILED DESCRIPTION

In an internal combustion engine having at least one cylinder which is directly supplied with fuel by an injector, the present invention proposes determining the proportion of fresh air in the cylinder using the pressure in the fuel line when the injector is open. According to the invention, at only a small cost and without additional sensors, the influence of the pressure of the charge of fresh air in the cylinder on the pressure of the fuel in the fuel line is used to determine the amount of fresh air in the cylinder. Therefore, according to the invention, the understanding is utilised that when the injector, connected to a fuel line, is opened, the pressure of the fuel in the fuel line is influenced by the pressure of the fresh air in the cylinder and, using this pressure, it is possible to determine the proportion of fresh air in the cylinder, the pressure sensor arranged in the fuel line simply being used for this purpose. According to the invention, the proportion of fresh air in the cylinder can be determined using the absolute pressure in the fuel line when the injector is open. This takes place, for example, in conjunction with an association between the absolute pressure in the fuel line when the injector is open and the proportions of fresh air in the cylinder. This association is created, for example, in the development phase of the internal combustion engine. According to the invention, it is also possible to determine the proportion of fresh air in the cylinder using the reduction in pressure in the fuel line when the injector is open compared to the pressure in the fuel line when the injector is closed or compared to a predetermined pressure value. This relative consideration of a drop in pressure has the advantage that, where there are different fuel pressure levels, it is possible to work with merely an association between a drop in pressure in the fuel line by opening the injector and the proportion of fresh air in the cylinder. If the internal combustion engine has a plurality of cylinders, the proportion of fresh air can be determined for each cylinder by the method according to the invention, so that it is possible to compare the proportions of fresh air in the individual cylinders with one another. If the proportions of fresh air in the cylinders differ from one another by a specific amount, it is possible to detect an error and display it. According to the invention, opening the injector to determine the pressure in the fuel line with an open injector can be carried out in the upper dead centre of the piston in the cylinder. In other words, according to the invention, the injector can be opened in addition to the actual supply of fuel to the cylinder. According to the invention, the determination of the pressure in the fuel line when the injector is open can also be incorporated into an existing model for the supply of fuel into the cylinder.

Figure 1:
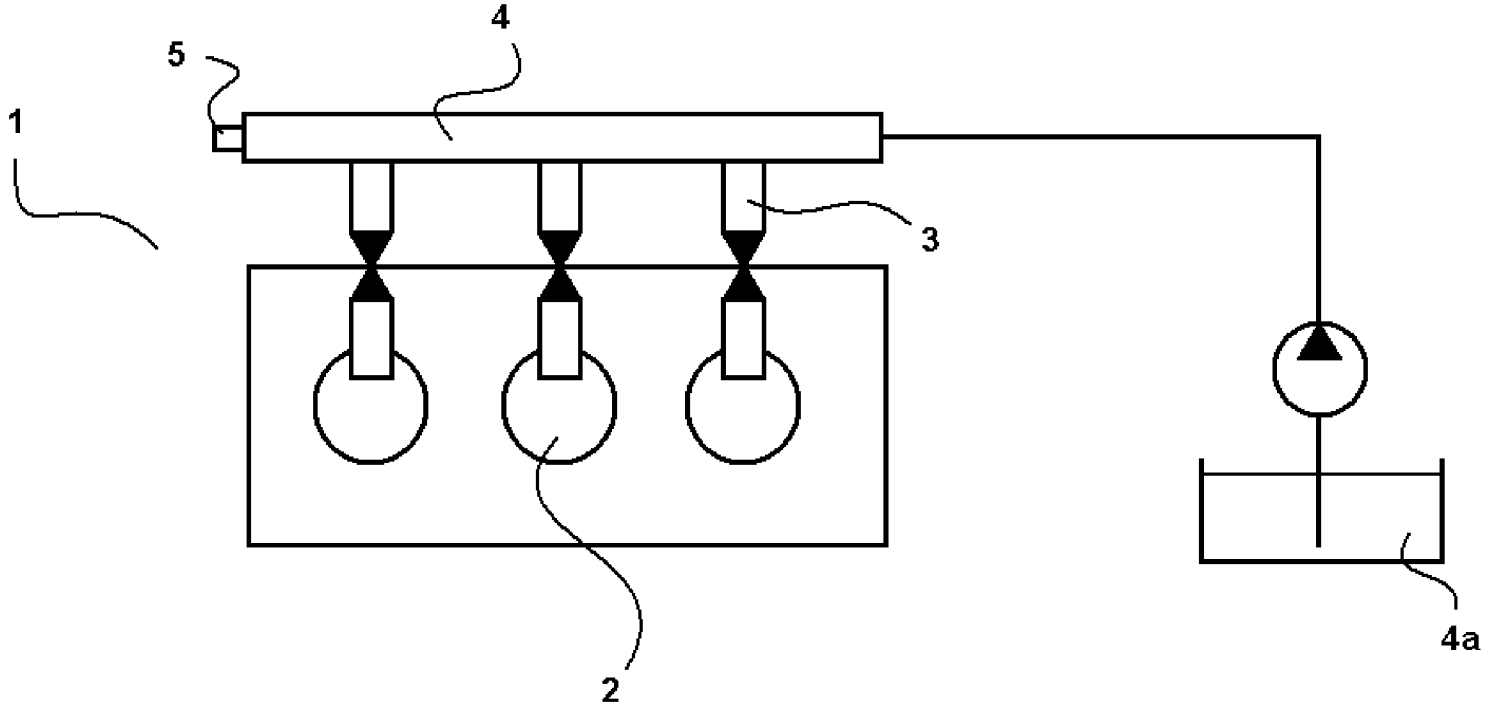
FIG. 1 is a schematic illustration of an internal combustion engine.

As shown by FIG. 1, an internal combustion engine 1 comprises one or more cylinders 2. Injectors 3 feed fuel directly into the cylinders 2. As FIG. 1 shows, the injectors 3 are connected on one side to a fuel line 4 which, in turn, is connected to a tank 4*a*. On the other side, the injectors 3 are connected to the cylinders 2 or to the combustion chambers. A pressure sensor 5 is arranged in the fuel line 4, particularly in the region of the arrangement of the injectors 3. The pressure sensor 5 is used, for example, to detect an actual value of the pressure in the fuel line 4, so that, in conjunction with the presetting of an actual value for the pressure in the fuel line 4, the pressure in the fuel line 4 is initially adjusted, as is generally known. According to the invention, the actual value of the pressure in the fuel line 4 is also used to determine the proportion of fresh air contained in the cylinders. While the fuel is fed directly into the cylinders 2, a specific volume or a specific mass of fuel is removed from the fuel line 4, so that a particular reduction in pressure occurs in the fuel line 4.

Figure 2:
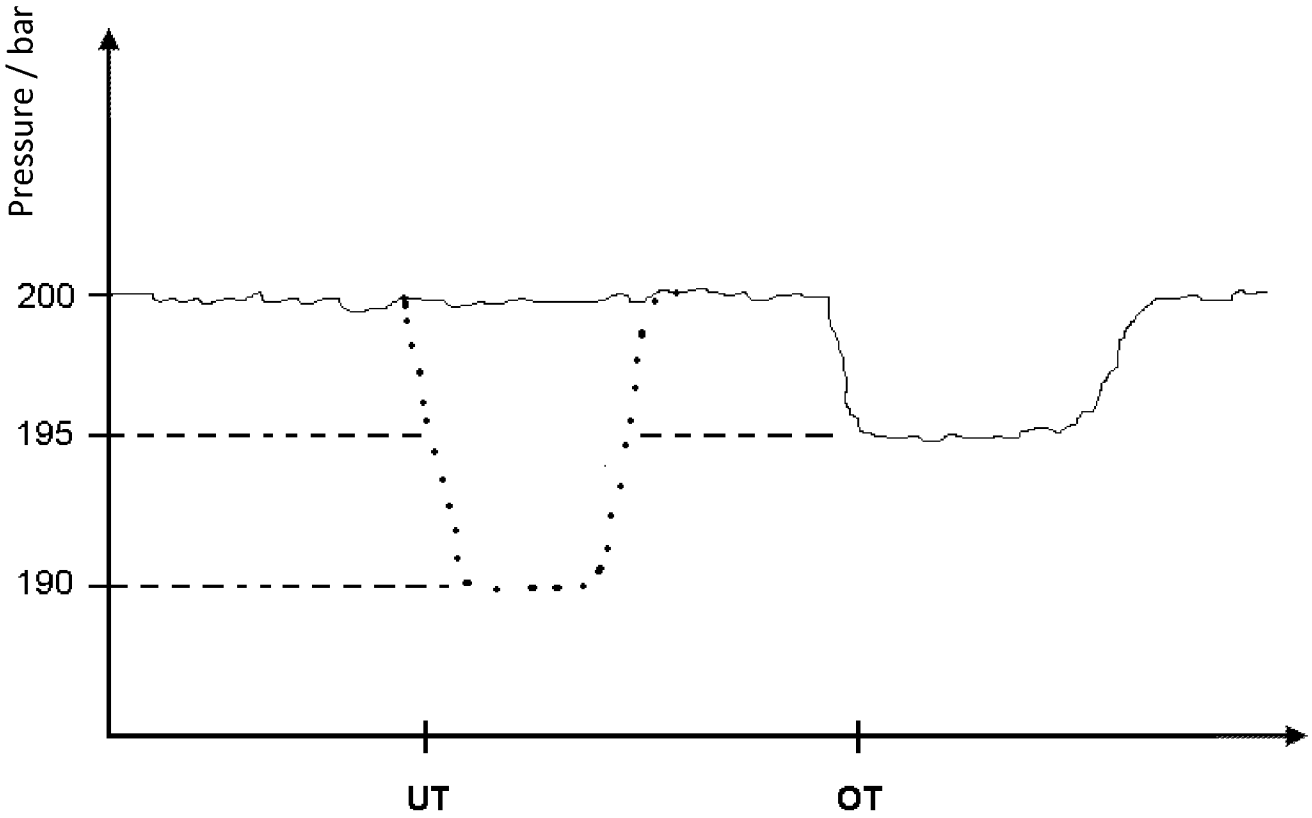
FIG. 2 is a schematic illustration of the pressure in the fuel line of an internal combustion engine.

As shown in FIG. 2 by way of example by the continuous line, when the piston in a cylinder 2 is in the lower dead centre (LDC) position, the pressure, determined by the pressure sensor 5, in the fuel line 4 amounts to 200 bar, no fuel being directly fed by the injector 3 from the fuel line 4 to the combustion chamber or cylinder 2, i.e. the injector 3 is closed. For example, when the piston in a cylinder 2 is in the upper dead centre (UDC) position, the pressure in the fuel line 4 is only 195 bar, since fuel is fed directly by the injector 3 to the combustion chamber or cylinder 2 from the fuel line 4, i.e. the injector 3 is open. As described above, when the piston in the cylinder 2 is in the upper dead centre (UDC) position, the pressure of the gaseous working medium in the cylinder 2, i.e. predominantly the pressure of the proportion of fresh air contained in the cylinder 2 also has, however, a specific value which is above the pressure of the ambient air, since, as is known, the compression phase has finished and due to the reduction in the piston capacity of the cylinder 2, the pressure of the gaseous working medium contained in the cylinder 2 has increased. The pressure of the gaseous working medium in the cylinder 2 now also influences the pressure of the fuel in the fuel line 4. That is to say, due to the fact that when the injector 3 is open, there is a connection between the cylinder 2 or combustion chamber and the fuel line 4, the pressure of the gaseous working medium in the cylinder 2 influences the state of the fuel in the fuel line 4. In other words, the "counter pressure", i.e. the "respective cylinder pressure" at the combustion chamber-side end of the injector 3 has an influence on the pressure in the fuel line 4 by detuning the present choke character via the injector 3. This is described based on the example shown in FIG. 2.

Assuming that the piston in the cylinder 2 is not in the upper dead centre (UDC) position, but for example is in the lower dead centre (LDC) position, then the pressure in the fuel line 4, starting from 200 bar, is only 190 bar even when the same volume of fuel is fed directly to the combustion chamber or cylinder 2 by the injector 3 from the fuel line 4, as in the aforementioned case, and the injector 3 is open. This is shown in FIG. 2 by the dotted path. Continuing this approach, the proportion of fresh air in the cylinder 2 accordingly also influences the pressure of the fuel in the fuel line 4 when the injector 3 is open. As is generally known, a relatively small proportion of fresh air in the cylinder 2 produces a pressure of the gaseous medium in the cylinder 2 in the upper dead centre of the piston 2 which is less than the pressure which prevails when a relatively great proportion of fresh air is contained in the cylinder 2. This understanding is now exploited according to the present invention. For this purpose, for example an association is made between a reduction in the pressure of the fuel in the fuel line 4 and the pressure of the gaseous medium in the cylinder 2 when the injector 3 is open which takes place, for example, in the development phase of the internal combustion engine 1. In this respect, for example, known and precise cylinder pressure sensors are used to determine the pressure of the gaseous medium in the cylinder 2 in the upper dead centre of the piston and from this, the proportion of gaseous working medium or the proportion of fresh air, i.e. the mass or amount of gaseous medium in the cylinder 2 is determined, using the known specific gas equation ($p*V=m*R*T$), where p is the pressure, V is the volume, m is the amount of gas in moles, R is the ideal gas constant, and T is the temperature.

Other methods can also be used to determine the proportion of gaseous working medium or the proportion of fresh air in the cylinder 2 for the purpose of creating an association between the pressure of the fuel in the fuel line 4 or the reduction thereof during a supply of fuel and the pressure of the gaseous medium in the cylinder 2, such as a measurement of the proportion of fresh air flowing towards the cylinder 2 by means of a hot-wire anemometer, i.e. an HFM. This experimental determination of the proportion of gaseous working medium or of the proportion of fresh air in the cylinder 2 is carried out for different load points of the internal combustion engine 1, in other words, for example, starting from a fully open flow cross section to the cylinder 2, this cross section progressively decreases, for example by means of a known throttle valve. Thus, a respective value for the reduction in the pressure of the fuel in the fuel line 4 can be associated with any number of proportions of gaseous working medium. In a very simple case, in a first step of this experimental determination, the actual value of the pressure of the fuel in the fuel line 4 chronologically before the injector 3 is opened, which pressure is measured by the pressure sensor 5, is 200 bar. However, when the injector 3 is opened, this pressure is 195 bar, for example when the piston 2 is in the upper dead centre, the flow cross section to the cylinder 2 being completely clear, i.e. the maximum filling capacity of the cylinder 2 has been achieved.

According to the invention, the value of 100% full is associated with the actual value of the pressure of the fuel in the fuel line 4 of 195 bar. In a further step, the actual value of the pressure of the fuel in the fuel line 4 chronologically before the injector 3 is opened, which pressure is measured by the pressure sensor 5, is again 200 bar. However, when the injector 3 is opened, this pressure is 190 bar, again when the piston 2 is in the upper dead centre, the flow cross section to the cylinder 2 not being completely clear, i.e. only half the filling capacity of the cylinder 2 has been achieved. According to the invention, the value of 50% full is associated with the actual value of the pressure of the fuel in the fuel line 4 of 190 bar. In yet a further step, the actual value of the pressure of the fuel in the fuel line 4 chronologically before the injector 3 is opened, which pressure is measured by the pressure sensor 5, is again 200 bar. However, when the injector 3 is opened, this pressure is 180 bar, again when the piston 2 is in the upper dead centre, the flow cross section to the cylinder 2 being almost fully closed, i.e. only one tenth of the maximum filling capacity of the cylinder 2 can be achieved. According to the invention, the value of 10% full is then associated with the actual value of the pressure of the fuel in the fuel line 4 of 180 bar.

To summarise, the present invention makes use of the effect that with an increasing filling of the cylinder 2, the pressure in the cylinder 2 at the end or near the end of the compression phase also increases and, in contrast thereto, the reduction in the pressure of the fuel in the fuel line 4 when the injector 3 is open decreases with an increasing pressure in the cylinder 2. The association, arrived at by experiments, between the reduction in the pressure in the fuel line 4 at the end or near the end of the compression phase and the filling of the cylinder 2 or the proportion of fresh air in the cylinder 2 is expediently stored in the control device of the internal combustion engine 1 as a table/characteristic curve, if necessary as a multi-dimensional combination of configuration-dependent characteristic diagrams.

During normal operation of the internal combustion engine 1, i.e. in the use phase of the internal combustion engine 1, the pressure sensor 5 is simply used to determine the pressure in the fuel line and, in conjunction with the mentioned association, the proportion of fresh air is determined which is present in the cylinder 2 in this working cycle. The described determination, according to the invention, of the proportion of fresh air in the cylinder 2, subject to the reduction of the pressure in the fuel line 4 when the injector 3 is open can naturally also be carried out when there are different desired and actual values for the pressure in the fuel line 4. Thus, instead of being 200 bar, this value can also be 300 bar. For this purpose, it may be expedient, instead of considering the absolute reduction in the pressure in the fuel line 4 when the injector 3 is open, to work with a relative reduction in the pressure in the fuel line 4 when the injector 3 is open to determine the proportion of fresh air in the cylinder 2. In other words, in the association according to the invention, the absolute values for the pressure in the fuel line 4, when the injector 3 is open, are not associated experimentally with a proportion of fresh air in the cylinder 2, but a proportion of fresh air in the cylinder 2 is associated with a pressure differential. This pressure differential is calculated by subtracting the pressure value which occurs in the fuel line 4 when the injector 3 is open from the desired value of the pressure in the fuel line 4 or from the pressure value measured by the pressure sensor 5 when the injector 3 is closed. Based on the example, mentioned above, of an experimental association in each case of a specific proportion of fresh air in the cylinder 2 with a reduction in the absolute pressure in the fuel line 4 when the injector 3 is open, a respective specific proportion of fresh air in the cylinder 2 is now associated experimentally with a pressure differential which is formed as described above. In the region in which the injectors 3 are arranged and in which the pressure sensor 5 is also arranged, the fuel line 4 is preferably configured as a common pressure accumulator (common rail).

According to the invention, the described determination of the proportion of fresh air in the cylinder 2, subject to the signal from the pressure sensor 5 for each cylinder 2 of an internal combustion engine 1 is realised such that according to the invention, it can advantageously be determined for each working cycle of the internal combustion engine 1 which proportion of fresh air is contained in which cylinder 2. In this manner, the respective proportions of fresh air in the individual cylinders 2 can be compared with one another, so that, if the proportions of fresh air differ from one another by a specific amount, an error can be detected and displayed. The region in which the injector 3 is opened to determine the reduction in pressure in the fuel line 4, with an open injector 3, in respect of the crank angle or the time, to again determine according to the invention the proportion of fresh air in the cylinder 2 is preferably in the upper dead centre of the piston in the respective cylinder 2. Of course, the method according to the invention is also effective when the reduction in pressure in the fuel line 4, with an open injector 3, is determined in a region before reaching the upper dead centre of the piston in the cylinder 2.

According to the invention, the determination of the reduction in the pressure in the fuel line 4 when the injector 3 is open can thus be advantageously incorporated into an existing model a supply of fuel into the cylinder 2 or combustion chamber. According to the invention, when the injector 3 is open or closed, the pressure in the fuel line 4 can be determined by forming an average from a plurality of measured values established by the pressure sensor 5. Of course, other characteristic quantities which can be derived from the signal of the pressure sensor 5 when the injector 3 is open can also be used to determine the proportion of fresh air in the cylinder 2 using the pressure in the fuel line 4 with an open injector 3. It is conceivable, for example, in this respect to use the gradient of the reduction in pressure in the fuel line 4, which occurs directly with or after the opening of the injector 3, either alone or in conjunction with an absolute pressure in the fuel line 4 when the injector 3 is open or alternatively with a reduction in pressure in the fuel line 4 when the injector 3 is open, compared to the pressure in the fuel line 4 when the injector 3 is closed or compared to a predetermined pressure value.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

The invention claimed is:

1. A method for determining an amount of fresh air in a first cylinder of an internal combustion engine, the method comprising:

a) opening an injector, the injector being connected to a fuel line in which a pressure sensor is arranged;

b) measuring a pressure in the fuel line when the injector is open;

c) determining an amount of fresh air in the first cylinder using the pressure measured in the fuel line when the injector is open in conjunction with an association between pressure measured in the fuel line when the injector is open and amount of fresh air in the first cylinder;

d) determining an amount of fresh air contained in at least one additional cylinder of the internal combustion engine;

e) comparing the amount of fresh air contained in each of the at least one additional cylinder with the amount of fresh air in the first cylinder; and f) detecting and displaying an error if the amounts of fresh air differ from one another by a specific amount.

2. The method according to claim 1, wherein the amount of fresh air in the first cylinder is determined in (c) using the absolute pressure in the fuel line when the injector is open.

3. The method according to claim 1, wherein the amount of fresh air in the first cylinder is determined in (c) based on a reduction in pressure in the fuel line when the injector is open, compared to a pressure in the fuel line when the injector is closed or compared to a predetermined pressure value.

4. The method according to claim 2, wherein during a development phase of the internal combustion engine, an association between absolute pressure in the fuel line when the injector is open and amount of fresh air in the first cylinder is created, and amount of fresh air in the first cylinder is determined in (c) using the association created during the development phase of the internal combustion engine between absolute pressure in the fuel line when the injector is open and the amount of fresh air in the first cylinder.

5. The method according to claim 3, wherein during a development phase of the internal combustion engine, an association between reduction in pressure in the fuel line when the injector is open compared to pressure in the fuel line when the injector is closed or compared to a predetermined pressure value and the amount of fresh air in the first cylinder is created, and wherein the amount of fresh air in the first cylinder is determined in (c) using the association created during the development phase of the internal combustion engine between reduction in pressure in the fuel line when the injector is open compared to pressure in the fuel line when the injector is closed or compared to a predetermined value and amount of fresh air in the first cylinder.

6. The method according to claim 1, wherein the injector is opened in the upper dead centre of the piston in the first cylinder to determine the pressure in the fuel line when the injector is open.

7. The method according to claim 1, wherein the injector is opened in a region before reaching the upper dead centre of the piston in the first cylinder to determine the pressure in the fuel line when the injector is open.

8. The method according to claim 1, wherein the pressure in the fuel line when the injector is open measured in (b) is incorporated into an existing model for supply of fuel into the first cylinder.

9. The method according to claim 1, wherein pressure in the fuel line, when the injector is open or closed, is determined by forming an average from a plurality of measured values, established by the pressure sensor, over a period of time.

* * * * *